United States Patent [19]

Häberle

[11] 3,960,335

[45] June 1, 1976

[54] COMMINUTION DEVICE FOR SCRAP PLASTICS

[76] Inventor: Wilhelm Häberle, Industriegelande, Scheer, Wurttemberg, Germany

[22] Filed: Nov. 5, 1974

[21] Appl. No.: 520,930

Related U.S. Application Data

[63] Continuation of Ser. No. 316,442, Dec. 19, 1972, abandoned.

[30] Foreign Application Priority Data

Dec. 24, 1971 Germany ..... 2164566

[52] U.S. Cl. ..... 241/236; 241/152 A; 241/DIG. 28

[51] Int. Cl.[2] ..... B02C 18/14; B02C 18/26

[58] Field of Search ..... 241/DIG. 28, 234–236, 241/152 A, 152 R, 154

[56] References Cited

UNITED STATES PATENTS

| | | | |
|---|---|---|---|
| 2,462,692 | 2/1949 | Vickers | 241/236 X |
| 2,995,775 | 8/1961 | Schnitzius et al. | 241/235 X |
| 3,217,988 | 11/1965 | Lightfoot et al. | 241/154 X |

FOREIGN PATENTS OR APPLICATIONS

| | | | |
|---|---|---|---|
| 1,291,606 | 3/1969 | Germany | 241/236 |
| 454,623 | 9/1936 | United Kingdom | 241/236 |
| 771,877 | 4/1957 | United Kingdom | 241/236 |

*Primary Examiner*—Roy Lake
*Assistant Examiner*—E. F. Desmond
*Attorney, Agent, or Firm*—Ernest F. Marmorek

[57] ABSTRACT

A comminution device for the conversion of scraps of plastic into a free-flowing granulated material is provided without having to repeatedly feed the same scrap plastic into the device. The scraps of plastic are cut both longitudinally and transversely with the two types of cuts intersecting each other. Anti-clogging screens are not required.

4 Claims, 8 Drawing Figures

COMMINUTION DEVICE FOR SCRAP PLASTICS

This is a continuation, of application Ser. No. 316,442, filed Dec. 19, 1972 now abandoned.

BACKGROUND OF THE INVENTION

1. Field of the Invention

The invention relates to communication devices and more particularly to such a device for the conversion of scraps of plastics, especially of thermoplastic foils and blow mold particles, into a free-flowing granulated material.

2. Description of the Prior Art

A knife and driving shaft assembly is arranged in a housing and cooperates with a counterknife assembly whereby the goods to be comminuted can be fed to the knife and driving shaft assembly with the present invention relating to a suitable and advantageous design of such a comminution device. Crushers of the type designed for the comminution of scraps of plastics are already known. In the prior forms of structure two or more cutter-beams are provided which are connected to a rotating shaft, with the cutter beams cooperating with a stationary knife. The foil to be chopped up is first cut into strips and these strips have to be repeatedly fed again to the knives or cutters in order to obtain a free-flowing mass. Moreover, screens are provided for the cutting-crushers which prevent the granular material emerging from the crusher before a certain grain size is obtained.

In the prior art the scraps to be comminuted had to be repeatedly rotated around with the knife and driving shaft assembly which meant that not only was the cost of the prior art crusher considerable, but that above all, the collected scraps were not processed in a continuous manner. Rather, breakdowns of the operations occurred through cloggings or through an insufficient processing capacity. Moreover, siren-like noises were created due to the knives or cutters rotating at high rotational speeds and this interfered with the operating personnel.

Based on the high noise level of between 90 and 105 decibles depending on the type of construction of the crusher, the use of thickwalled cast elements and anti-droning devices it has not as yet been feasible to use cutting crushers as supplementary devices to a processing machine since the noises of the crushers can be heard above the noises of the processing machine, so that the acoustical control of the latter was not possible. Furthermore, thin foils, such as for example adhesive tapes, cannot be comminuted with hitherto known crusher structures since the cutting gap between the rotating and the stationary curring-beans cannot be adjusted to a dimension equalling approximately half of the foil thickness.

Summary of the Invention

Therefore, the present invention provides a comminution device of the aforementioned type, which however does not, have the disadvantages of the known types of structure of such comminution devices, and which nevertheless is very simple in its construction. The present invention can be manufactured at reasonable costs, and furthermore creates a free-flowing mass with each cutting process, without the scraps to be comminuted having to be fed repeatedly to the knives or cutters. Above all, the operational noises of the present invention are kept at a low level, so that bothersome inconveniences to the operating personnel are avoided as much as possible. Moreover, the comminution devices of the present invention, having high operating safety and low susceptibility to trouble, is easily adaptable to the given situations, especially as it concerns the processing capacity of a deep-drawing molding machine for plastics.

In accordance with the present invention, the foregoing objects and advantages are achieved by the knife and driving shaft assembly and the counterknife assembly which in each case comprises individual knives, that are mounted on their respective shaft in a rotation-resistant manner and which are laterally spaced from one another. The knives are also arranged in such a manner that the knives of the knife and driving shaft assembly are interposed between the knives of the counterknife assembly and that the knives of the latter are interposed between the knives of the knife and driving shaft assembly.

The knives of the knife and driving shaft assembly and/or of the counterknife assembly are supported in an axial direction with respect to their supporting shafts by means of springs or the like, with the tension forces of the springs or the like being preferably adjustable. Thus the springs can be arranged, in each case, in a concentric manner with respect to the knives of the knife and driving assembly shaft and/or of the counterknife assembly, or can be arranged in the area covering the latter. Moreover, it is desirable to provide butting disks and/or butting rollers, along the lines of an axial roller bearing, for the knives of the knife and driving shaft assembly and/or for the knives of the counterknife assembly. In this manner it is assured that the knives lie in a satisfactory manner against one another and that an accurate comminution of the foil is guaranteed.

In another embodiment of this invention, spacers can also be inserted, for the same purpose, between the knives of the knife and driving shaft assembly and/or those of the counterknife assembly. The spacers of this embodiment, in their axial extent, are at least as wide or are wider than the knives of the counterknife assembly or of the knive and driving shaft assembly.

Furthermore, it is desirable to mount the knives of the knife and driving shaft assembly and/or those of the counterknife assembly in a rotation-resistant manner on many sided shaft, for example on a hexagonal shaft.

In order to prevent the foil that is to be comminuted from sticking to the knives, it is furthermore advantageous to arrange scraping or raking elements between the knives of the knife and driving shaft assembly and/or of the counterknife assembly. The scraping elements engage the knives in a manner of a comb, whereby the scraping or raking elements can be suspended from one or several axles and are narrower than the space between two adjacent knives.

The knife and driving shaft assembly and the counterknife assembly can be driven jointly or separately in a synchronous or an asynchronous manner, for example by means of intermeshing gears, sprockets or pulley wheels together with V-belts, chains, or the like as appropriate.

In an especially advantageous form of the invention the knives of the knife and driving shaft assembly and/or of the counterknife assembly can comprise toothed disks, whereby the tips of the teeth are formed as knife edges and the bottom portion of the teeth are formed as counterknives which cooperate in each case with the adjoining knives. In order to save material, it is appropriate to work the toothed disks, which form the knife and driving shaft assembly and/or the counterknife assembly, out of the bore of the boss or hub of the toothed disk of the counterknife assembly of the knife and driving shaft assembly.

According to another embodiment of this invention the knives of the knife and driving shaft assembly and/or of the counterknife assembly can also be formed as smooth disks, as disks with knurled peripheral edge areas or as disks with cone-shaped cross-sectional forms. Thus, a so-called impact-knife, which comprises a stationary and one or several rotating knife-beams, can be provided for the knives, as can be a cutting tool, or a so-called impact-knife which rotates perpendicularly to the feed direction of the foil. In an advantageous manner, the cutting tool can comprise a cutter wheel which is provided with milled gashes cut in a helicoidal form into the area of the external surface and which cooperates with a counterknife that preferably can be adjusted automatically by one or several springs, with the counterknife being, for example, a pivotable one.

In order to make it possible to introduce the foil or the blow mold particles in a satisfactory manner, the inlet portion of the housing of the comminution device of this invention may be supplied with a preferably adjustable inlet sheet that comprises means for holding down the material to be introduced into the comminution device.

The granulated material can be removed by means of a worm conveyor, which preferably is arranged parallel to the knife and driving shaft assembly or by means of a chain conveyor, a suction fan, or the like.

The comminution device of this invention is especially advantageous if it is installed beyond a processing machine for plastics, whereby the knife and driving shaft assembly and/or the counterknife assembly of the comminution device could be in driving connection with the processing machine, by means of a shiftable clutch, for adaptation to the timing of the processing machine.

A comminution device designed in accordance with the present invention distinguishes itself not only by its extremely simple construction and by its low manufacturing costs, but above all by a high working capacity, with good adaptability to any given situation. If the knife and driving shaft assembly and the counterknife assembly are comprised of individual knives of different shapes which are laterally spaced apart at such a distance from one another that the knives overlap one another or plunge into one another, then the foil to be comminuted is cut up into free-flowing goods in one working step and the comminuted goods can be removed immediately. Through the shape and driving velocity of the knives as well as the rate of advance of the foil, the grain size of the granulated material can be determined in a simple manner, whereby an adaptation to the processing rate of the plastic processing machine is possible. Moreover, compared to hitherto known cutting crushers, fewer structural elements are required, which moreover can also be more simple in their design, since retaining screens and the like are not needed.

Furthermore, the comminution device designed according to the present invention assures a high operational reliability or safety. The granulated material can be removed directly after it has been chopped up, without causing operational disturbances brought about, for example, by foil strips which get stuck in the screen in the interspaces between the knives. However, what is of special importance is that bothersome noises do not occur, since it is assured by the construction of the knife and driving shaft assembly and of the counterknife assembly, that these will not act as a siren, that is to say will not produce a siren-like noise. Moreover, one will not have to be bothered by dust, since the foil or the blow mold particles are not ground up, but are chopped up into rectangular pieces in one or two operational stages. The comminution device designed in accordance with the present invention thus makes possible a fast and satisfactory processing of scraps of plastics without large constructional and operational expenditures.

BRIEF DESCRIPTION OF THE DRAWING

Further details of the comminution device designed according to the present invention can be deduced from the embodiments illustrated in the attached drawings and explained in detail in the following herein.

DESCRIPTION OF THE PREFERRED EMBODIMENT

Figure 1:
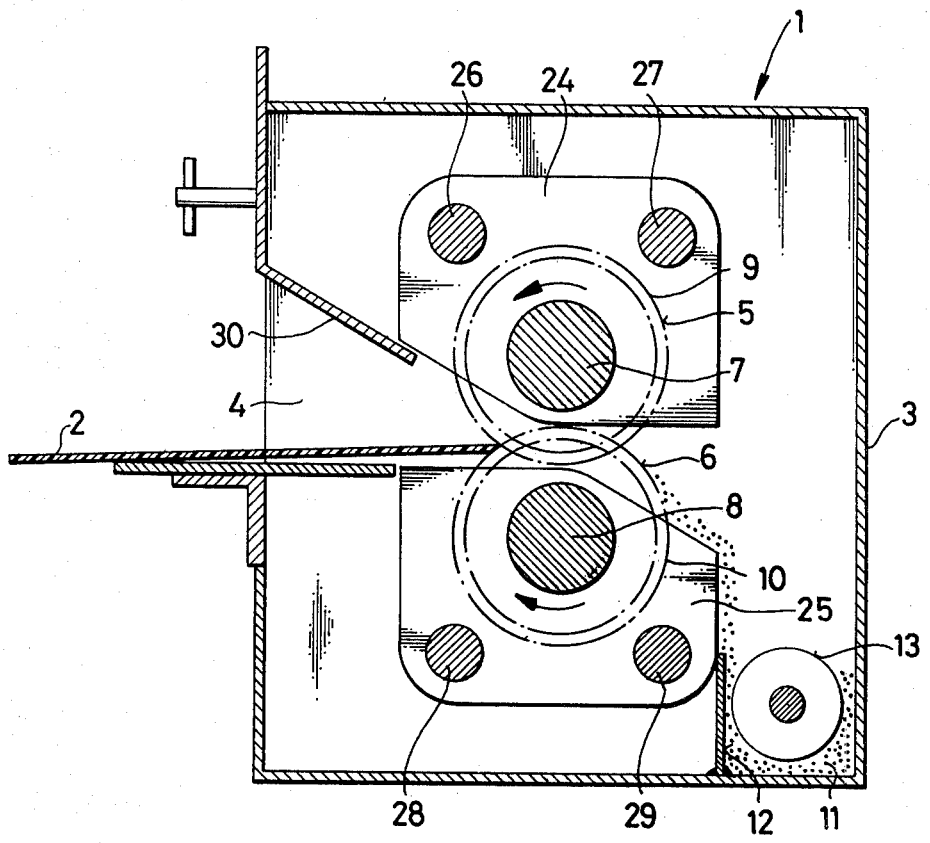
FIG. 1 is a transverse sectional view of the comminution of the present invention.
Figure 2:
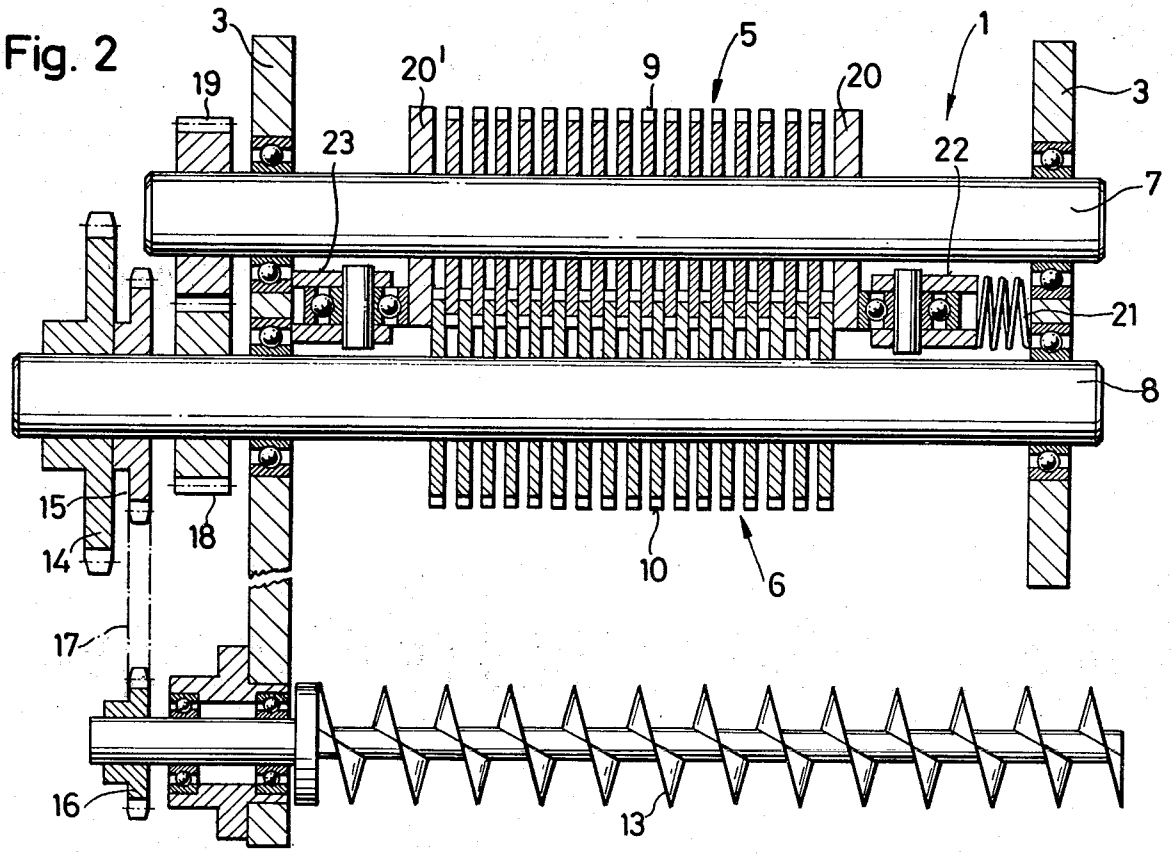
FIG. 2 is a longitudinal, sectional view of the comminution device shown in FIG. 1.

The comminution device which is designated with reference number 1 and which is shown in FIGS. 1 and 2 provides means, for the comminution of scraps of plastics into a free-flowing granulated material 11 and especially provides means for the comminution of a thermoplastically moldable foil designated by the reference character 2. The present invention comprises a knife and driving shaft 5 assembly that is built into a housing 3, and also includes a counterknife assembly 6 which cooperates with the knife and driving shaft assembly 5. The knife and driving shaft assembly 5 and the counterknife assembly 6 are, in each case, formed by knives 9 and 10 which are arranged on shafts 7 and 8, respectively, with the foil 2 being fed, via an inlet opening 4 of the housing 3 to the knives 9 and 10. The foil 2 is thereby comminuted into the granulated material 11 which, in turn, is collected in a container 12 and is transported away by means of a worm conveyor 13.

The knife and driving shaft assembly 5 and the counterknife assembly 6 are driven by a motor which is not shown in the driving. The cutting-crusher or comminution device 1 cooperates with a processing machine for plastics, through the intervention of a timing motor or direct by with a processing machine via driving means, with a sprocket wheel 14 that is mounted on the shaft 8. By means of another sprocket wheel 15 which is also mounted on the shaft 8, and through the intervention of an additional sprocket wheel 16, which is connected with the worm conveyor 13, as well as through the intervention of a chain 17, the worm conveyor 13 is driven. By means of gears 18 and 19, which mate with one another, the knife and driving shaft 5 assembly is in driving connection with the counterknife assembly 6, whereby, depending on the choice of the ratio of the gears 18 and 19, the drive can by chosen to be synchronous or asynchronous.

The knives 9 of the knife and shaft assembly 5 which are mounted non-rotatably on the shaft 7 and the knives 10 of the counterknife assembly 6 which are mounted non-rotatably on the shaft 8 are, in each case laterally spaced from each other such that the periphery of the knives 9 of the knife and shaft assembly 5 are positioned between and radially inward of the knives 10 of the counterknife assembly 6. The periphery of the knives 10 of the counterknife assembly 6 are positioned between and radially inward of the knives 9 of the knife and shaft assembly 5. In order to achieve this, one or more springs 21 cooperate with the knives 9 and 10, with the spring or springs 21 acting upon the knives 9 and 10 through the intervention of a butting roller 22 as well as a terminal disk 20. In this manner it is guaranteed that the knives 9 and 10 lie close to one another. Through the intervention of another terminal disk 20', as well as another butting roller 23, the system can be braced in a rotatable manner against housing 3.

In order to prevent the remains of the foil 2 from sticking to the knives 9 or 10, scrapers 24 and 25 are inserted between the knives, as illustrated in FIG. 1. The scrapers 24 and 25 are mounted in a loose manner on axles 26, 27 and 28, 29, respectively, and are made narrower than the knives 9 and 10, so that they can automatically adjust themselves. Moreover, an adjustable device 30, designed to hold down the foil 2, is provided at the inlet opening 4, through which a reliable feed of the foil 2 to the knife and shaft assembly 5 and the counterknife assembly 6 is guaranteed.

Figure 2A:
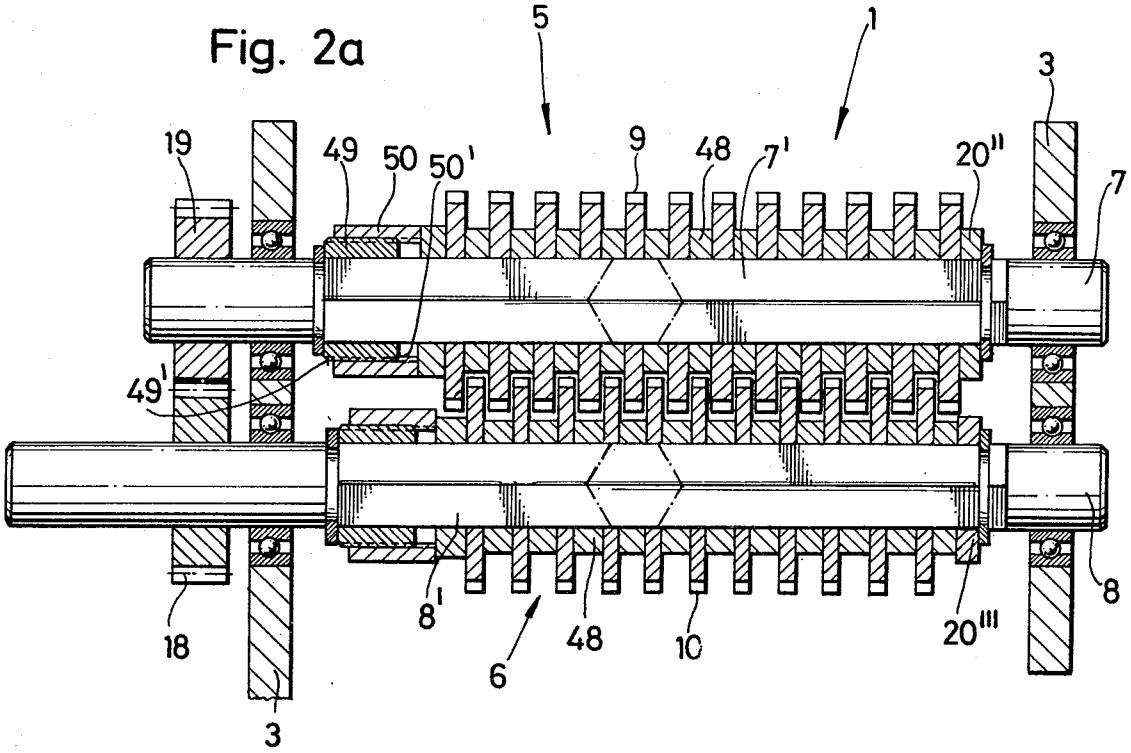
FIG. 2*a* is a longitudinal, sectional view of an alternate embodiment of the comminution device shown in FIG. 2.

According to FIG. 2*a*, spacers 48, in a different type of construction of the cutting crusher or comminution device 1, are arranged between the knives 9 and 10, and are mounted, respectively on shaft portions 7' and 8'. The axial dimension of the spacers 48 is greater than the width of the knives 9 and 10 which are arranged in the same manner as described in connection with the first embodiment. The axial dimension of the spacers 48 exceeds the width of the knives 9 and 10 by 0.2mm, for example, thereby guaranteeing a non-contact operation, while nevertheless providing a satisfactory comminution of the foil 2.

Moreover, in the embodiment shown in FIG. 2*a*, the shafts 7 and 8 which carry the knives 9 and 10 and are driven by means of the gear wheels 18 and 19 and are housed in housing 3, are formed with the hexagonal shaft portions 7' and 8', so that the knives 9 and 10 are likewise mounted on the shafts 7 and 8 in a rotation-resistant manner. In order to be able to brace the knives 9 and 10 in an axial direction, nuts 50 are provided which are screwed onto sleeves 49. When the nuts 50 are turned with respect to the sleeves 49, which are braced so as to be stationary, and for the purpose of accepting the nuts 50 are provided with internal threads 50' or external threads 49', the sleeves 49 are displaced in an axial direction and act directly, or through the intervention of spacers, on the knives 9 or 10, which brace themselves against terminal disks 20'' or 20'''. In this manner a satisfactory support system for the knives 9 and 10 is assured.

Figure 3:
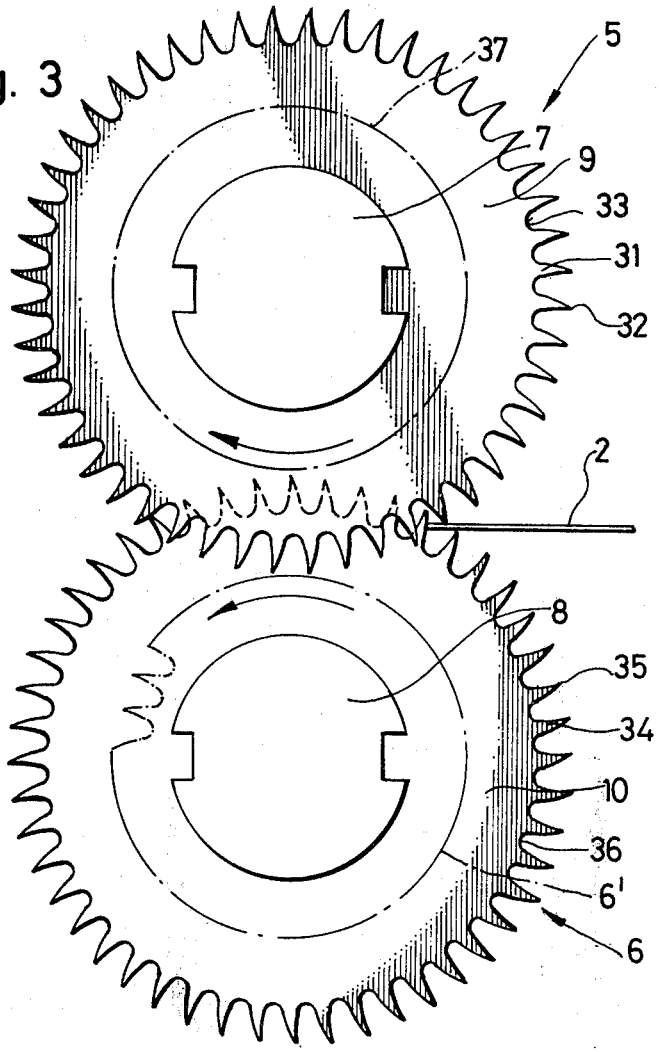
FIG. 3 is an elevational view that shows the cutting knife as well as the counterknife used in the comminution device shown in FIGS. 1 and 2, with the knives being shown on an enlarged scale.

As shown in FIG. 3, the knives 9 and 10 are comprised of disks, into which teeth 31 and 34, are formed. The tips of the teeth 31 and 34 are fashioned in each case as cutting edges 32 and 35, respectively, and act as cross-cutters of the foil 2 whereas bottom sections 33 and 36 of the teeth 31 and 34, respectively, cut the foil 2 in a longitudinal direction. The portion punched-out from the bore of hub 37 of the knife 9, for reasons of economy, can be used, in accordance with the dash-dotted representation, as knife 10' of the counterknife assembly 6.

Figure 4:
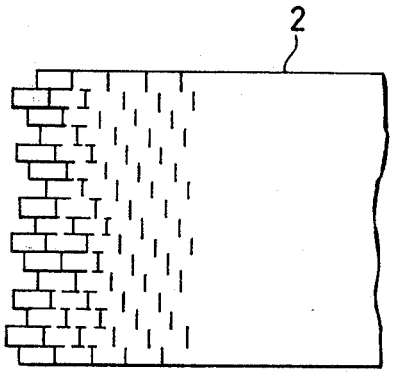
FIG. 4 is a plane view that shows the foil in the individual stages of the comminution process.

When the foil 2 is fed into the comminution device 1 it is seized by the knives 9 and 10 as soon as it comes into the range of the teeth 31 and 34 and, in accordance with FIG. 4, is cut in a transverse direction by the tips 32 and 35, respectively. The foil 2 is thereby drawn into the comminution device 1, so that separate feed rollers are not required. Through the bottom sections 33 and 36 of the teeth 31 and 34 of the knives 9 and 10, and since the latter, through force of spring 21 lie close to one another, the foil 2 is cut longitudinally into the granulated material 11, which is transported away by means of the worm conveyor 13. The scrapers 24 and 25, which are arranged between the knives 9 and 10, prevent residual pieces of the foil 2 from clinging to the knives 9 and 10.

Figure 5:
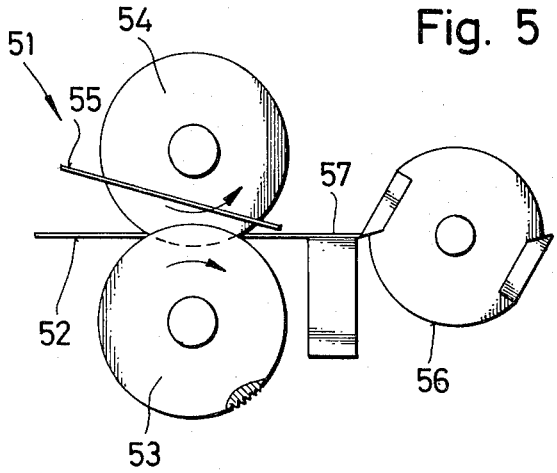
FIG. 5 is a schematic, transverse view that shows another alternative embodiment of the comminution device comprising this invention.

In the case of the comminution device 51, which is schematically represented in FIG. 5 and in which case a foil 52 is fed into the system for comminution purposes, the knife and driving shaft assembly 53 is formed of several edged disks and the counterknife assembly 54 is formed of several smooth disks. The disks of the knife and driving shaft assembly 53 and of the counterknife assembly 54 again mate with one another as described in connection with the first embodiment. Moreover a raking member 55 is provided between the disks of the counterknife assembly 54, for the purpose of scraping off residual pieces of the foil 52 that might adhere to the knives.

By means of the knife and driving shaft assembly 53 and the cooperating counterknife assembly 54, the foil 52 is first cut into longitudinal strips in this embodiment of the comminution device. In order to further comminute these strips into a granulated material, a so called impact knife 56 is installed beyond the knife and driving shaft assembly 53 and the counterknife assembly 54 through which, together with a knife-beam 57, the strips of the foil 52 are chopped up transversely.

Figure 6:
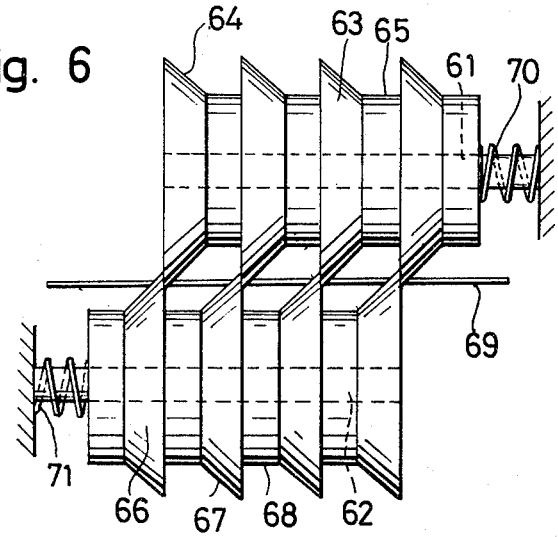
FIG. 6 shows another type of construction of the cutting and counterknife assemblys in the case of a comminution device designed according to FIGS. 1 or 5.

A knife and driving shaft assembly 61, as well as a counterknife assembly 62 which are shown in FIG. 6, are made up of disks 63 and 66, which in each case are formed of cone-shaped portions 64 and 67, respectively, and of cylindrical portions 65 and 68, respectively. Since springs 70 and 71 act on the disks 63 and 66, the sides of the cone-shaped portions 64 and 67 having the larger diameters lie, in each case, close to one another, so that foil 69 is cut longitudinal by them into strips and the resulting strips are then chopped up transversely into small segments by means of a so called impact knife or the like which is installed beyond disks 63 and 66 and is not shown in FIG. 6.

Figure 7:
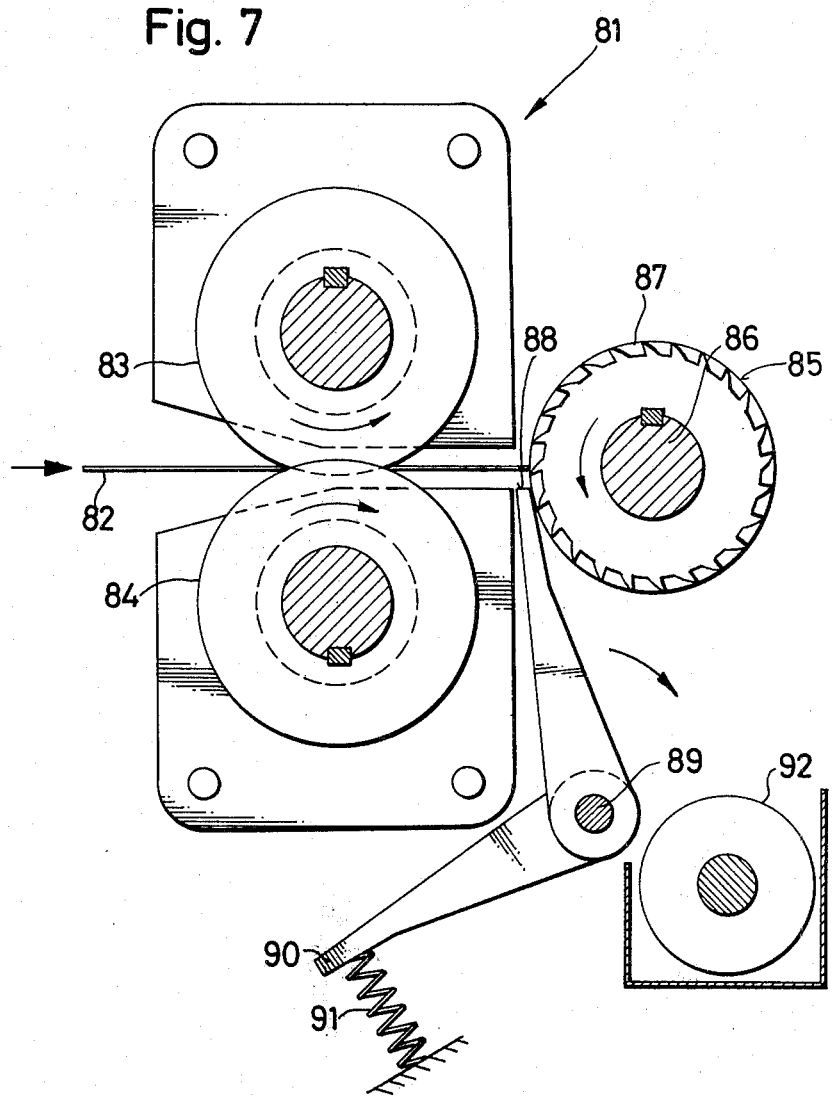
FIG. 7 is a schematic, transverse view that shows another alternative embodiment of a comminution device which is connected on the outlet side with a cutting tool.

The comminution device 81 shown in FIG. 7, which provides for the comminution of foil 82 which is fed to this system, again comprises a knife and driving shaft assembly 83 and a counterknife assembly 84, whereby the individual knives, which are fashioned in the form of smooth or edged disks, sink into one another in the same manner as described in connection with the previous embodiments. Beyond the comminution device 81, through which the foil 82 is first cut into strips, a cutting tool 85 is installed, which comprises a toothed cutter 87, that is mounted on a driven shaft 86 and furthermore comprises a second counterknife assembly 88. In this embodiment the second counterknife assembly 88 is arranged in a pivotable manner and constantly bears against the toothed circuit 87. For this purpose, a pivotably mounted shaft 89 is provided, with which both the second counterknife assembly 88, as well as lever 90 are rigidly connected.

A spring 91 acts on a lever 90 so that the second counterknife assembly 88 is constantly pressed against the toothed cutter 87. Thus, a gap between the cutting edges of the toothed cutter 87 and the second counterknife assembly 88 is not present. So that the second counterknife assembly 88 can not be drawn into the knife 87, it is appropriate to furnish it with helicoidal grooves or with cross pieces extending all around it. By means of a conveying device 92 the granulated material produced by the comminution device 81 and by the cutting tool 85, is fed to a receiving drum.

I claim:

1. A comminution device for the conversion of scraps of plastic such as thermoplastically moldable foils or blow mold particles into a free-flowing, granulated material, said scraps being fed into said device in one direction, said device comprising:

a housing;

a knife and driving shaft assembly including a first shaft journalled for rotation in said housing, and a first plurality of axially spaced apart knives mounted on said first shaft for rotation together therewith; and a counterknife assembly including a second shaft journalled for rotation in said housing, and a second plurality of axially spaced apart knives mounted on said second shaft for rotation together therewith, the periphery of said first plurality of knives being disposed between and radially inward of the periphery of said second plurality of knives whereby said first and said second plurality of knives are cooperatively associated with each other for cutting the plastic; and further including a cutting tool and an impact knife cooperating therewith, said cutting tool and said impact knife being rotatable about an axis that is perpendicular to the feed direction of the foil or blow mold particles.

2. The comminution device in accordance with claim 1 wherein said cutting tool comprises a toothed roller having helicoidal gashes formed on the peripheral surface thereof.

3. The comminution device in accordance with claim 1 wherein said impact knife is adjustably biased by spring means.

4. A comminution device for the conversion of scraps of plastic such as thermoplastically moldable foils or blow mold particles into a free-flowing, granulated material comprising:

a housing;

a knife and driving shaft assembly including a first shaft journalled for rotation in said housing, and a first plurality of axially spaced apart knives mounted on said first shaft for rotation together therewith; and a counterknife assembly including a second shaft journalled for rotation in said housing; and a second plurality of axially spaced apart knives mounted on said second shaft for rotation together therewith, further including means for applying an axially directed force on said first and said second plurality of knives and a force transferring means said force transferring means comprises roller bearing means interposed between said force applying means and said first and said second plurality of knives being disposed between and radially inward of the periphery of said second plurality of knives whereby said first and said second plurality of knives are cooperatively associated with each other for cutting the scraps of plastic into said granulated material.

* * * * *